United States Patent [19]

Floyd

[11] 4,375,855

[45] Mar. 8, 1983

[54] TRANSPORTABLE PRODUCE PROCESSING HOUSE

[76] Inventor: Ueal D. Floyd, P.O. Box 1608, Palatka, Fla. 32077

[21] Appl. No.: 210,347

[22] Filed: Nov. 25, 1980

[51] Int. Cl.[3] ..... B07C 7/04

[52] U.S. Cl. ..... 209/705; 198/311; 198/950; 209/935

[58] Field of Search ..... 209/702, 705, 606, 938, 209/935; 52/23, 143, 195; 198/300, 311, 523, 525, 860, 861, 866, 950; 414/332

[56] References Cited

U.S. PATENT DOCUMENTS

| | | | |
|---|---|---|---|
| 227,337 | 3/1880 | Wiestling . | |
| 713,484 | 11/1902 | Nelson . | |
| 1,897,901 | 2/1933 | Hagopian | 414/786 |
| 2,336,775 | 12/1943 | Brest . | |
| 2,601,922 | 7/1952 | Fahey | 198/950 X |
| 2,625,309 | 1/1953 | Cox . | |
| 2,769,539 | 11/1956 | Packman | 209/935 X |
| 3,452,492 | 7/1969 | Brockway | 52/143 X |
| 3,547,266 | 12/1970 | Michel | 209/435 X |

*Primary Examiner*—James G. Smith
*Assistant Examiner*—Douglas D. Watts
*Attorney, Agent, or Firm*—Kerkam, Stowell, Kondracki & Clarke

[57] ABSTRACT

A produce processing house such as a cabbage packing house is mounted on wheels and towable from location to location. Centrally of the house are superposed main conveyors which extend from a produce receiving section exterior of the house substantially the length of the house and a lower culls receiving conveyor. Along one wall, is a take-away conveyor which also extends the length of the house and parallel to the main conveyor. The culls and take-away conveyors are each provided with elevating conveyors at their discharge ends.

3 Claims, 5 Drawing Figures

TRANSPORTABLE PRODUCE PROCESSING HOUSE

DESCRIPTION

1. Technical Field

This invention relates to a produce processing house such as a cabbage packing house that is mounted on wheels and is towable from location to location thereby reducing to a minimum transportation of the produce prior to processing such as culling and boxing.

2. Background of the Prior Art

Conventional produce processing houses are generally relatively small and are built to accommodate local produce growing areas. Interiorly of the houses are usually a plurality of stations where the produce is culled, weighed, cut and packaged. Generally such stations are served by conveyor belts which bring the produce to the stations and packed goods from the stations.

The cost of produce producing houses is substantial in view of the mechanical conveying mechanism necessary for proper operation while utilization of such structures is limited by the proximity of the processing houses to the growing local. The following patents are exemplary of such prior art stuctures. Nelson—U.S. Pat. No. 713,484; Hagopian U.S. Pat. No. 1,897,901 and Brest U.S. Pat. No. 2,336,775.

BRIEF SUMMARY OF THE INVENTION

It is an object of the pressent invention to provide a produce, processing house that is mounted on wheels and towable from location to location so that a larger growing area may be serviced by the processing house and to provide such a unit that reduces to a minimum transportation of produce prior to culling and packaging for the market.

In general the produce house such as a cabbage packing house may be generally defined as an elongated building structure mounted on wheels and towable from one location to another. Extending centrally of the house are mounted superposed main conveyors which extends from a produce receiving station exterior of the houses substantially the length thereof and a lower culls receiving conveyor. Along one wall of the house is a take-away conveyor which also extends the length of the house and parallel to the main and culls conveyors. The culls and take-away conveyors are each provided with elevating conveyors at their discharge ends. Positioned adjacent the main conveyor and between the main conveyor and the take-away conveyor are a plurality of operator stations each of which includes a produce container receiving station; preparing apparatus and/or weighing means and a cull chute communicating with the cull conveyor. The housing may also include produce container assembling bench extending longitudinally along a wall of the housing opposite the wall containing the take-away conveyor.

BRIEF DESCRIPTION OF THE DRAWINGS

The invention will be more particularly described in reference to the accompanying drawing wherein.

DETAILED DESCRIPTION OF THE INVENTION

Figure 1:
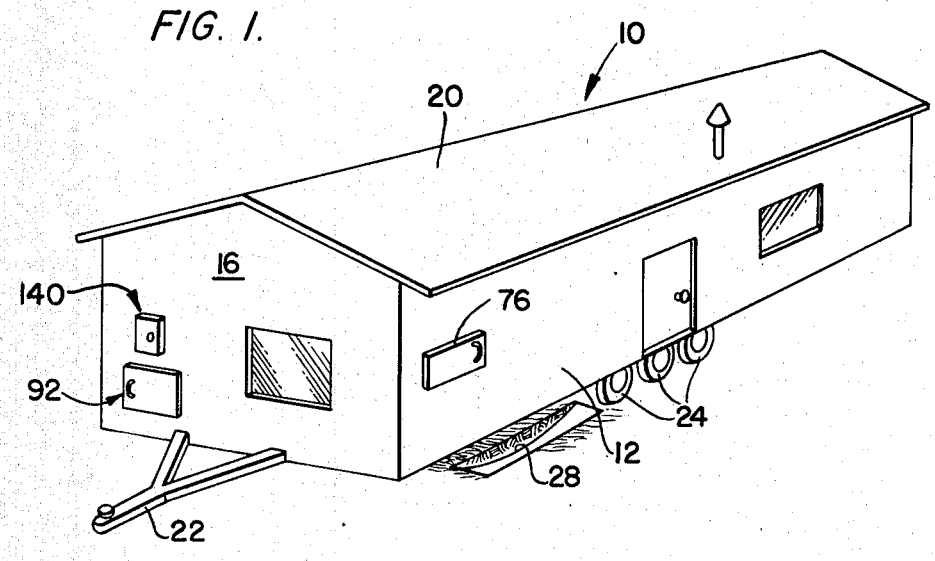
FIG. 1 is a perspective view of a preferred form of the produce, producing house of the invention.

Referring to the drawing 10 generally designates a produce processing house and in particular a cabbage packing house. In the illustrated enbodiment the house is elongate having side walls 12 and 14, end walls 16 and 18 and a roof 20. Typically the length of the side walls 12 would be about 65′ and the length of the end walls about 14′. The entire structure is mounted on a system of support beams not shown to which is connected at end 16 to a towing yoke 22. The support frame also rotatably support center wheel assemblies 24.

As illustrated in FIG. 1 after the vehicle has been towed to the desired location wheel receiving trenches generally designated 28 are dug in the earth so that when the mobile housing is moved forwardly the base of the house is flush or substantially flush with the ground level. Following this procedure it places the produce receiving end 30 of main conveyor 32 close to the ground so that there will be a minimum of transferring produce such as cabbages 34 from the transport vehicle 36 onto the receiving end 30 of the conveyor 32. The novel transport vehicle 36 will be described in greater detail hereinafter.

The main produce conveyor 32 extends lengthwise of the house 10 substantially in the center thereof and has an extended portion 30 hereinbefore described to receive the produce 34 and to convey it the length of the building.

The house has a plurality of produce processing stations designated A, B, C, D, E, F, G and H. The produce conveying conveyor has side frames 38 and 40 and conventional idler pullies 42 and a pulley drive, connected to motor M, about which the conveyor belt 44 is trained. With a building having an overall length of 65′ a suitable length for the main conveyor is 58° which conveyor would have a width of about 42″.

Below the main conveyor 32 is a cull conveyor 50. The cull conveyor would have a width of, for example, about 18″ and as more clearly shown in FIG. 5 the cull conveyor 50 runs centrally through the building below the main conveyor 32. The cull conveyor is also provided with side frame members 52 and 54 which like side panels 38 and 40 of the main conveyor 32 keep the produce from falling off the belting 56.

End 60 of the cull conveyor 50 discharges the culls onto elevating conveyor generally designated 62. The elevating conveyor has side walls 64 and 66 and the belting 68 carries on its outer surface a plurality of cleats 70 to lift the conveyed culls 72 upwardly through an openable panel 76 to a disposal vehicle or the like generally designated 80, FIG. 5 of the drawing. The elevating conveyor 62 is provided with a driven pulley 82 and an idler pulley 84. The driven pulley 82 is connected to one horse power electric motor $M_3$. The main conveyor 32, is driven by a five horse power variable speed motor $M_1$ whereas the cull conveyor 50 is driven by a two horse power electric motor $M_2$.

The produce processing house also includes a take-away conveyor generally designated 90. The take-away conveyor is positioned along wall 14 of the housing and extends from about wall 18 to wall 16 in a horizontal path to terminate adjacent and openable panel 92 whereby when the processing is in operation the end 94 of the take-away conveyor 90 communicates with one end 96 of an elevating conveyor 98 more clearly illustrated in FIG. 2 of the drawing which elevating conveyor lifts the processed and packaged produce to a heighth to permit simple off loading to a transporting vehicle. The elevating conveyor is driven by motor $M_4$ of about 3 horse power.

Figure 5:
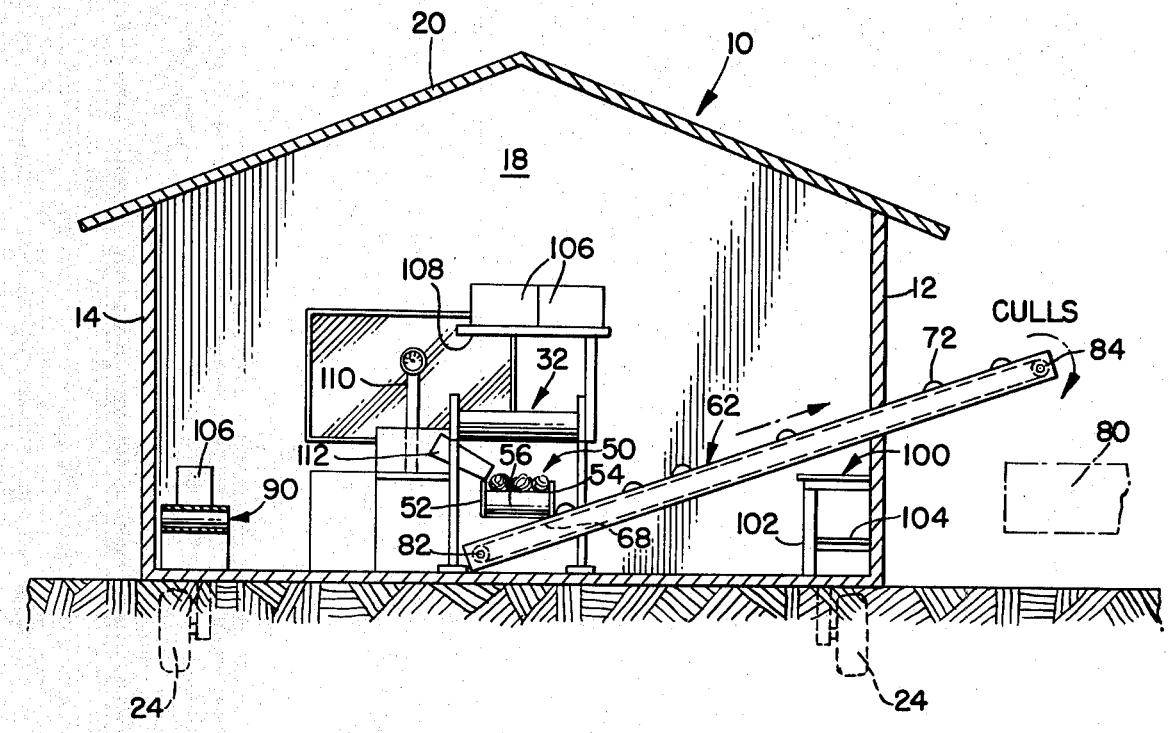
FIG. 5 is a section on line 5—5 of FIG. 4.

Along the inner wall 12 of the housing is a package make-up bench generally designated 100 which bench is supported by the wall and legs 102 illustrated in FIG. 5 of the drawing. Shelves above and below the bench 100, the former not be illustrated, 104 store knocked down cartons and workers such as indicated at W make up the boxes 106 and place them on upper rack 108 which extends above each station A, B . . . H so that they will be available to the process workers designated PW.

The assembly also includes weighing scales 110, at each station the platforms of which receive a box to be filled with the produce by workers PW. Further at each station A, B . . . H is a cull chute 112 which permits workers PW, to dispose of unsaleable produce or parts thereof which chutes communicate with the cull conveyor 50 as more clearly illustrated in FIG. 5 of the drawing. When a container 106 is filled or filled to the proper weight as the case may be it is moved by worker PW to the surface of take-away conveyor 90 to be discharged at its end onto the elevating conveyor 98.

Figure 3:
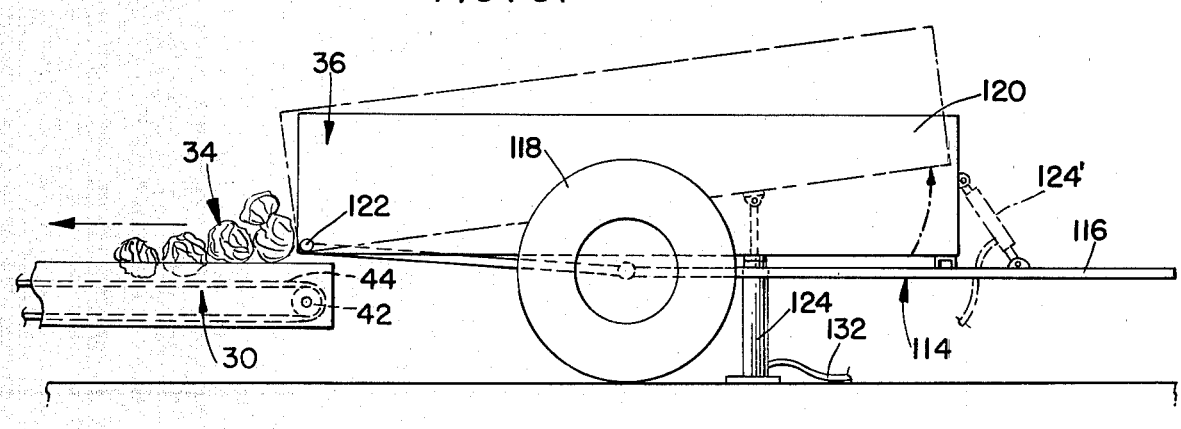
FIG. 3 illustrates a novel produce transporting vehicle unloading produce to the main conveyor of the produce processing house.
Figure 4:
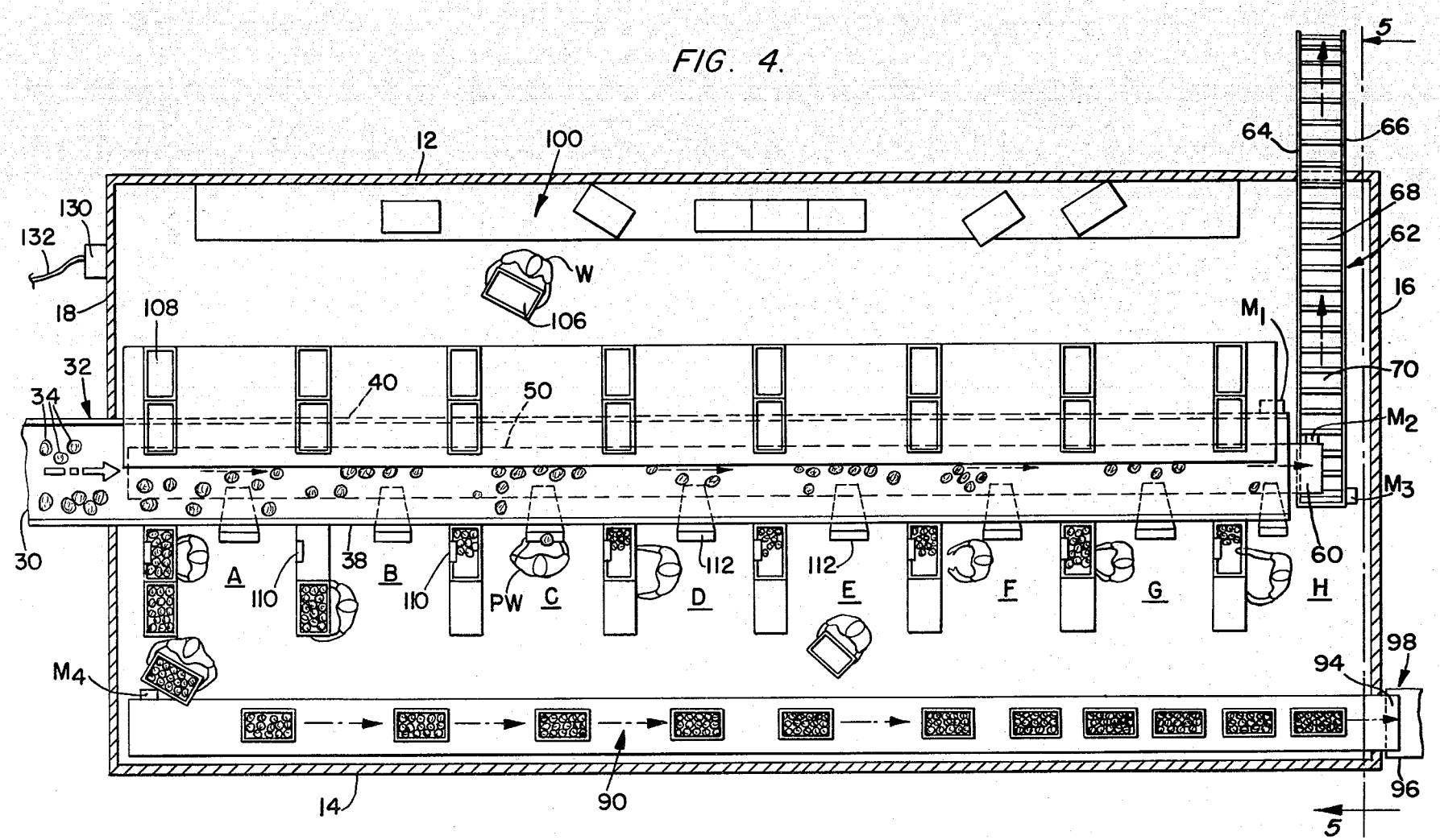
FIG. 4 a sectional plan view of the produce processing house illustrated in FIG. 2.

Referring now to FIG. 3 there is illustrated a transport vehicle which functions very adequately with the transportable produce processing house 10. The transporting vehicle includes a frame 114 connected to a draw bar 116. The frame is connected to ground engaging wheels 118 and has mounted thereon a produce receiving bin 120. The producing receiving bin is pivotally mounted at end 122 to the rear end of the frame 116 whereby when the vehicle is positioned above the main conveyor 32 at end 30 a hydraulic jack mechanism designated 124 is actuated via electrically drive hydraulic pump 130 which is connected to the jack 124 via conduits 132 so that the unloader may dispense the contents of the body 120 onto the upper surface of the conveyor 32 in an very expedient fashion with a minimum of produce damage. As illustrated by broken lines at 124' the hydraulic jack may function between draw bar 116 and the end wall of the body 120.

Figure 2:
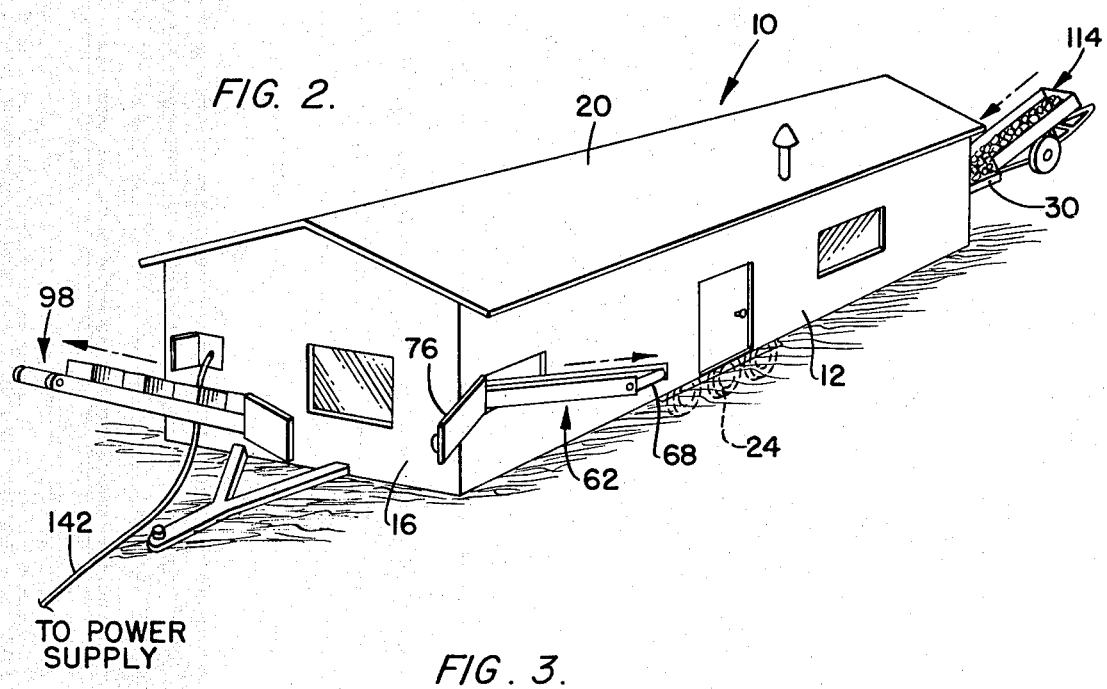
FIG. 2 is a view like FIG. 1 illustrating the produce processing house during operation.

The assembly also includes an electrical terminal 140 containing a power cable 142 FIG. 2 of the drawing which is connected to a source of electrical power for the plural conveyor motors, lights, etc., as needed. The power supply for the cable 42 may be line voltage or from an independent generator driven by an internal combustion engine.

While the transportable produce processing house has been described to such a structure for use in processing cabbages it will be apparent to those skilled in the art that produce such as apples, cantelope, celery, and the like requiring more or less processing may be substituted for the cabbage in the processing house of present invention.

I claim:

1. A produce processing house including side, end, bottom and top walls, wheels supporting said house, a draw bar connected to one end of the house to permit towing said house from location to location, a main produce transporting conveyor extending from a produce receiving station exterior of one end wall of said house, through an opening in said one end wall and then extending substantially the length of the house, said main produce transporting conveyor further located substantially centrally between the side walls of the house, a culls transporting conveyor positioned below the main produce transporting conveyor having a length substantially equal to the length of said house, each said main produce transporting conveyor and said culls transporting conveyor having means for moving produce toward the other end of said house, a take-away conveyor positioned along one side wall of said house and extending from said one end wall of said house, through a discharge opening in the other end wall of said house, a pair of elevating conveyor means, one of said pair of elevating conveyor means communicating with the culls transporting conveyor and the other of said pair of elevating conveyor means communicating with the take-away conveyor, a plurality of spaced produce processing stations extending the length of said house between the main produce transporting conveyor and the take-away conveyor, and a culls chute at each said processing station providing communication between each processing station and the said culls transporting conveyor.

2. The invention defined in claim 1 further including a produce receivable container assembling station positioned along the side wall of said house opposite the take-away conveyor.

3. The invention defined in claim 1 wherein said elevating conveyor means communicating with the culls transporting conveyor extends through an opening in one of the side walls of said house.

* * * * *